US011389023B2

(12) United States Patent
Cossalter et al.

(10) Patent No.: US 11,389,023 B2
(45) Date of Patent: Jul. 19, 2022

(54) SHOEHORN ASSEMBLY

(71) Applicants: Cristoforo Cossalter, Pitt Meadows (CA); Stefano Cossalter, Pitt Meadows (CA)

(72) Inventors: Cristoforo Cossalter, Pitt Meadows (CA); Stefano Cossalter, Pitt Meadows (CA)

( * ) Notice: Subject to any disclaimer, the term of this patent is extended or adjusted under 35 U.S.C. 154(b) by 269 days.

(21) Appl. No.: 16/479,476

(22) PCT Filed: Jan. 19, 2018

(86) PCT No.: PCT/CA2018/050066
§ 371 (c)(1),
(2) Date: Jul. 19, 2019

(87) PCT Pub. No.: WO2018/132922
PCT Pub. Date: Jul. 26, 2018

(65) Prior Publication Data

US 2019/0350397 A1 Nov. 21, 2019

Related U.S. Application Data

(60) Provisional application No. 62/448,047, filed on Jan. 19, 2017.

(51) Int. Cl.
*A47G 25/82* (2006.01)
*A47G 25/80* (2006.01)
(Continued)

(52) U.S. Cl.
CPC ..... *A47G 25/82* (2013.01); *A43B 1/0054* (2013.01); *A43B 11/00* (2013.01); *A47G 25/80* (2013.01); *A43B 23/26* (2013.01)

(58) Field of Classification Search
CPC .... A47G 25/82; A47G 25/80; A47G 2200/10; A47G 2200/103; A47G 25/86;
(Continued)

(56) References Cited

U.S. PATENT DOCUMENTS 2,628,007 A 2/1953 Meling
3,500,512 A * 3/1970 Zinni ..... A44C 1/00 24/499
(Continued)

FOREIGN PATENT DOCUMENTS

JP 3130122 3/2007
JP 2011092668 5/2011
(Continued)

OTHER PUBLICATIONS

International Search Report and Written Opinion issued in PCT/CA2018/050066 dated Jul. 26, 2018, 8 pages.

*Primary Examiner* — Jameson D Collier
*Assistant Examiner* — Matthew R Marchewka
(74) *Attorney, Agent, or Firm* — Arc IP Law, PC; Joseph J. Mayo

(57) ABSTRACT

An assembly for assisting a user in putting on footwear having a tongue includes a shoehorn portion and one or more attachment portions. The shoehorn portion includes an elongated handle and an engagement member. The engagement member includes a first surface and one or more shoehorn magnets situated proximate to the first surface. The attachment portions are removably attached to the tongue and include a clip and a body portion. The clip is configured to removably attached to the tongue. The body portion is connected to the clip and includes one or more attachment magnets configured to engage with the shoehorn magnets. The engagement of the attachment magnets to the shoehorn magnets allows the user to manipulate a movement of the tongue.

11 Claims, 7 Drawing Sheets

(51) Int. Cl.
*A43B 23/26* (2006.01)
*A43B 11/00* (2006.01)
*A43B 1/00* (2006.01)

(58) Field of Classification Search
CPC .... A47G 25/90; A47G 25/902; A43B 1/0054; A43B 11/00; A43B 11/02; A43B 23/26; A43B 23/24; A43B 3/0078; A43C 19/00; A43C 11/20; H01F 7/0257
USPC ..... 223/118, 119, 111, 113; 36/136, 138
See application file for complete search history.

(56) References Cited

U.S. PATENT DOCUMENTS 4,172,597 A * 10/1979 Smith ..... A63F 3/062 273/148 R
5,249,832 A * 10/1993 Leonardz ..... A47G 25/902 223/111
5,542,157 A * 8/1996 Herman ..... A44B 1/04 24/113 MP
5,655,693 A 8/1997 Engelman et al.
5,687,889 A * 11/1997 Liden ..... A47G 25/80 223/111
5,945,901 A * 8/1999 Coleman, Jr. ..... H01F 7/0257 335/285
5,974,701 A * 11/1999 Busch ..... A43B 11/00 223/111
5,999,074 A * 12/1999 Coleman, Jr. ..... H01F 7/0257 294/65.5
6,392,517 B1 * 5/2002 Coleman, Jr. ..... H01F 7/0257 294/65.5
8,142,252 B1 * 3/2012 Krull ..... A43B 23/24 446/268
9,259,055 B1 * 2/2016 Raynor ..... A43C 7/005
2011/0226821 A1 9/2011 McGuire
2012/0169076 A1 * 7/2012 Brake ..... A47G 25/902 294/3.6
2015/0209634 A1 * 7/2015 McMahon ..... A46B 5/0095 15/160
2019/0053580 A1 * 2/2019 Tarnow ..... A43C 7/04

FOREIGN PATENT DOCUMENTS

JP 2012152368 8/2012
JP 2015226744 A * 12/2015 ..... A47G 25/902

* cited by examiner

SHOEHORN ASSEMBLY

FIELD OF THE INVENTION

The present invention relates to devices for assisting a person in putting on footwear. In particular, the present invention relates to shoehorns that assist in maneuvering the tongue of footwear when the footwear is being put on.

BACKGROUND OF THE INVENTION

Shoehorns are tools that assist users in putting on shoes or other footwear. Typically, a shoehorn comprises a handle on one end and a smooth surface on the other end. The smooth surface allows for a user's heel to more easily enter into the shoe by allowing the heel to slide down the smooth surface into the shoe, before resting against the shoe's counter. At the same time, the user is able to grip the handle and use the shoehorn as a lever of sorts in order to further assist the heel in entering the shoe.

One type of shoehorn comprises an elongated handle. This allows the user to use the shoehorn without having to bend down or squat. This is especially helpful for users who lack mobility or are otherwise physically challenged.

Although shoehorns are helpful in assisting the entry of the user's heel into the shoe, many shoes also include a tongue, which is the flap that sits near the top central portion of the shoe. Before the shoe can be put on, it may be necessary to lift the tongue up (away from the opening of the shoe) in order to facilitate the entry of the foot into the opening. Otherwise, the tongue may not sit properly on the bridge of the foot after the entire foot has entered the shoe.

However, the lifting of the tongue away from the shoe's opening would also require the user to bend down or squat, which, as discussed above, may be difficult for some users. Therefore, it would be helpful to provide a device that could assist a user in putting on footwear without requiring the user to bend down or squat.

SUMMARY OF THE INVENTION

An assembly for assisting a user in putting on footwear having a tongue comprising a shoehorn portion and one or more attachment portions. The shoehorn portion comprises an elongated handle and an engagement member. The engagement member comprises a first surface and one or more shoehorn magnets situated proximate to the first surface. The attachment portions are removably attached to the tongue and comprise a clip and a body portion. The clip is configured to removably attached to the tongue. The body portion is connected to the clip and comprises one or more attachment magnets configured to engage with the shoehorn magnets. The engagement of the attachment magnets to the shoehorn magnets allows the user to manipulate a movement of the tongue.

In another embodiment of the invention, the engagement member further comprises a cavity for accommodating the shoehorn magnets.

In yet another embodiment, the shoehorn magnets lie substantially flush with the first surface.

In still a further embodiment, the clip comprises first and second clip surfaces configured to slide over a top and a bottom, respectively, of the tongue.

In another embodiment, the clip comprises a first clip surface, one or more protrusions, and fasteners. The first clip surface is configured to slide over a top of the tongue. The protrusions extend away from the first clip surface and are configured to extend through the tongue through openings formed on the tongue. The fasteners are attached to the protrusions and prevent removal of the clip from the tongue.

In still another embodiment, the body portion comprises an outer surface, wherein the attachment magnets are located on or proximate to the outer surface.

In yet another embodiment, the first surface comprises an engagement surface and a ridge, wherein the shoehorn magnets are located on or proximate to the engagement surface.

In still a further embodiment, the ridge is offset from the engagement surface by between 0 and 4 millimeters.

In still yet a further embodiment, the ridge prevents lateral movement of the shoehorn portion with respect to the attachment portion in one direction.

In a further embodiment, the shoehorn magnets are electromagnets.

In yet a further embodiment, the shoehorn portion further comprises a power source and a switch, wherein the power source and the switch are electrically connected to the electromagnets.

In another embodiment, a method for assisting a user in putting on footwear having a tongue comprises providing a shoehorn portion comprising an elongated handle and an engagement member, wherein the engagement member comprises one or more shoehorn magnets; attaching an attachment portion to the tongue, wherein the attachment portion comprises a clip configured to removably attach to the tongue and a body portion comprising one or more attachment magnets; moving the shoehorn portion to above the attachment portion such that the shoehorn magnets magnetically engage with the attachment magnets; moving the attachment portion, through the shoehorn portion, such that the tongue is moved away from the footwear; inserting a foot of the user partway into the footwear; and detaching the shoehorn portion from the attachment portion.

In a further embodiment, the step of detaching the shoehorn portion from the attachment portion comprises pulling the shoehorn magnets away from the attachment magnets.

In yet a further embodiment, the step of detaching the shoehorn portion from the attachment portion comprises twisting the elongated handle along a longitudinal axis.

The foregoing was intended as a summary only and of only some of the aspects of the invention. It was not intended to define the limits or requirements of the invention. Other aspects of the invention will be appreciated by reference to the detailed description of the embodiments.

BRIEF DESCRIPTION OF THE DRAWINGS

The preferred embodiments of the invention will be described by reference to the drawings thereof, in which.

DETAILED DESCRIPTION

Figure 1:
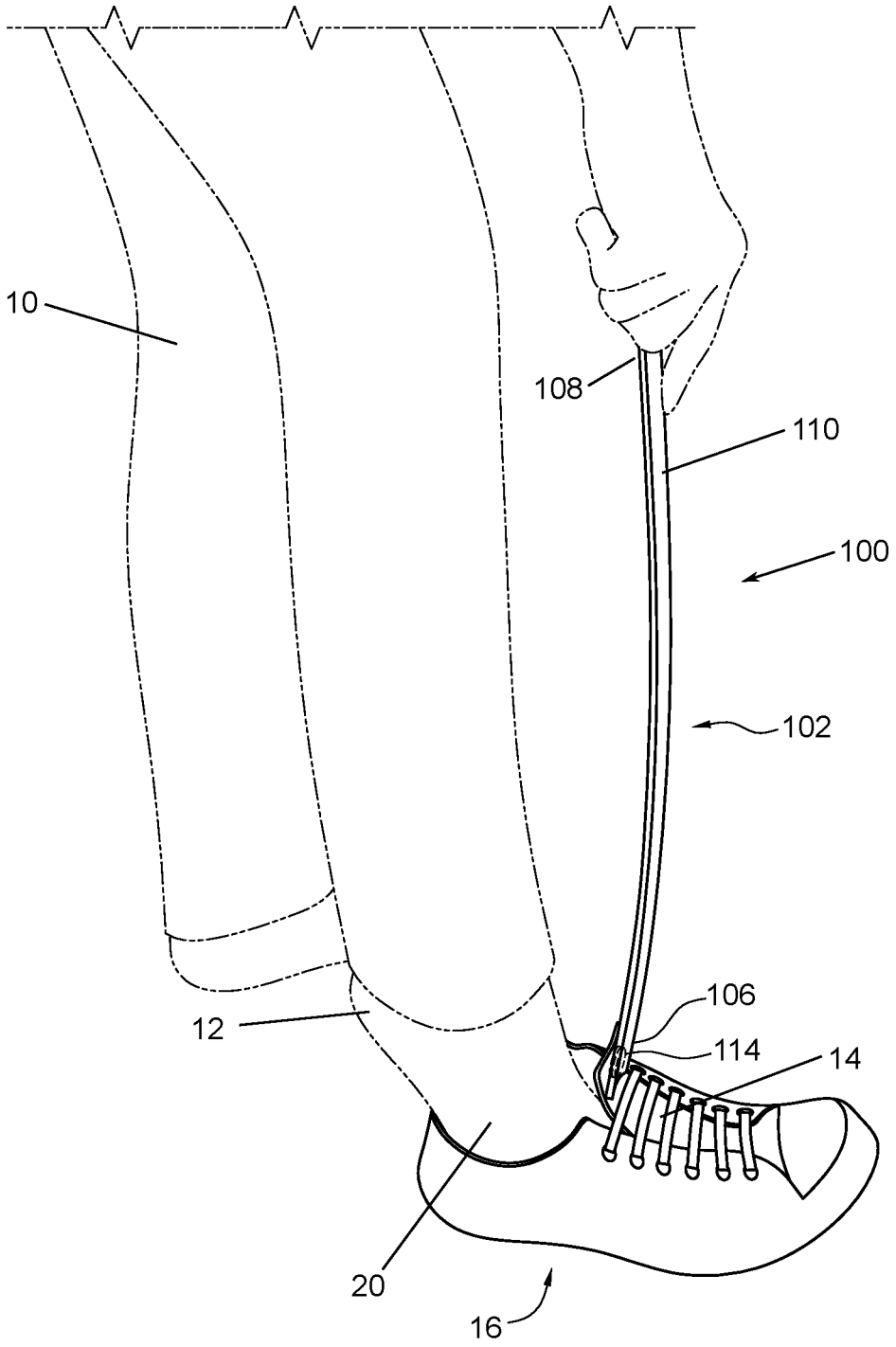
FIG. 1 shows an embodiment of the assembly in accordance with the present invention.
Figure 2:
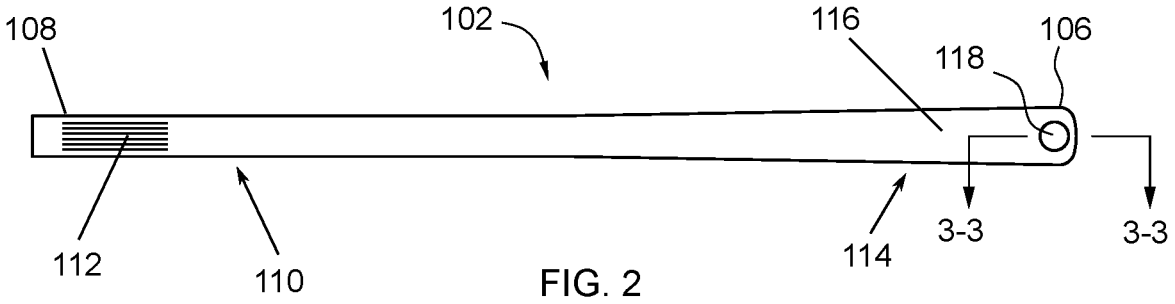
FIG. 2 shows the shoehorn portion of the assembly of FIG. 1.
Figure 3:
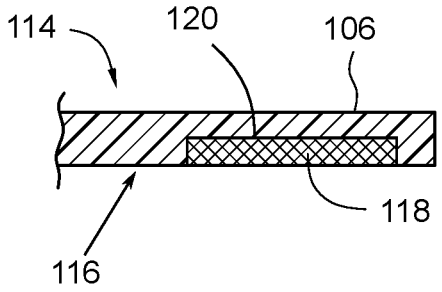
FIG. 3 is a partial cross-sectional view of the shoehorn portion of FIG. 2, taken along 3-3 of FIG. 2.

Referring to FIGS. 1 to 5, the assembly 100 in accordance with the present invention comprises a shoehorn portion 102 and one or more attachment portions 104. Referring to FIGS. 2 and 3, the shoehorn portion 102 comprises opposed first and second ends 106, 108. An elongated handle 110 is proximate to the second end 108, with the elongated handle 110 preferably comprising a grip surface 112 to facilitate gripping by a user 10. Proximate to the first end 106 is an engagement member 114 comprising a first surface 116 that is configured to engage with a heel 12 of the user 10. In order to better engage with the heel 12, at least a portion of the first surface 116 may be curved (to generally follow the curvature of the heel 12).

In addition, one or more shoehorn magnets 118 sit on or are situated proximate to the first end 106 (as best shown in FIG. 3). For example, in one embodiment, the shoehorn magnet 118 may sit within a cavity 120 formed on the engagement member 114, such that the shoehorn magnet 118 lies substantially flush with the first surface 116, as shown in the cross-sectional view of FIG. 3. In another embodiment, the shoehorn magnet 118 may be molded within the engagement member 114 such that it lies under the first surface 116. In the embodiment shown in FIGS. 2 and 3, the shoehorn magnet 118 has a generally cylindrical shape; however, it is understood that other shapes are also possible.

Figure 4:
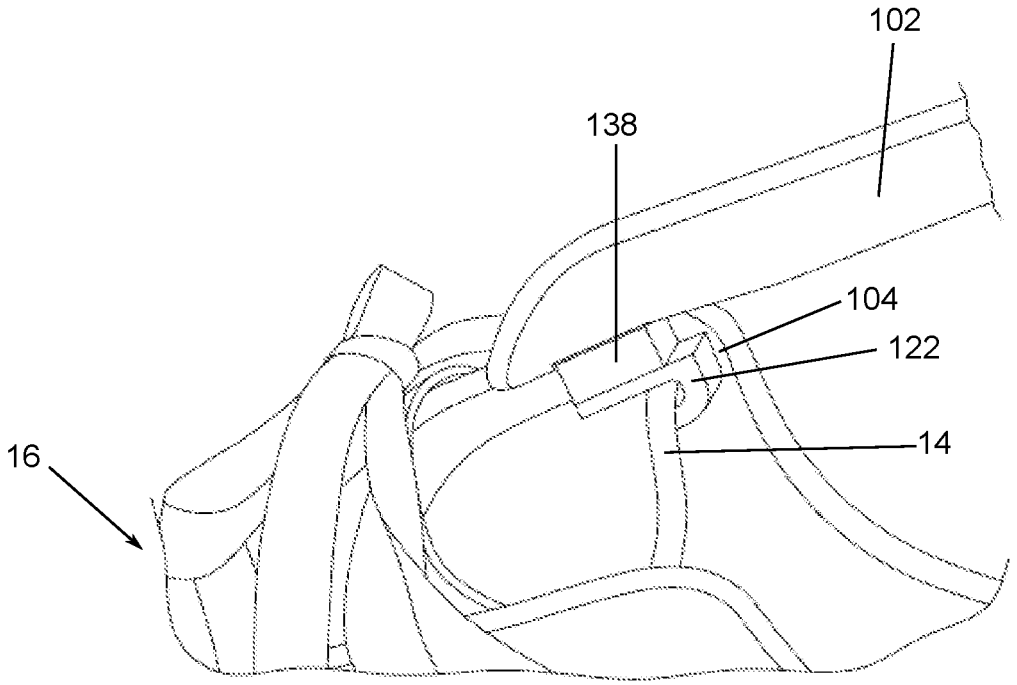
FIG. 4 is a perspective view showing the assembly.
Figure 5:
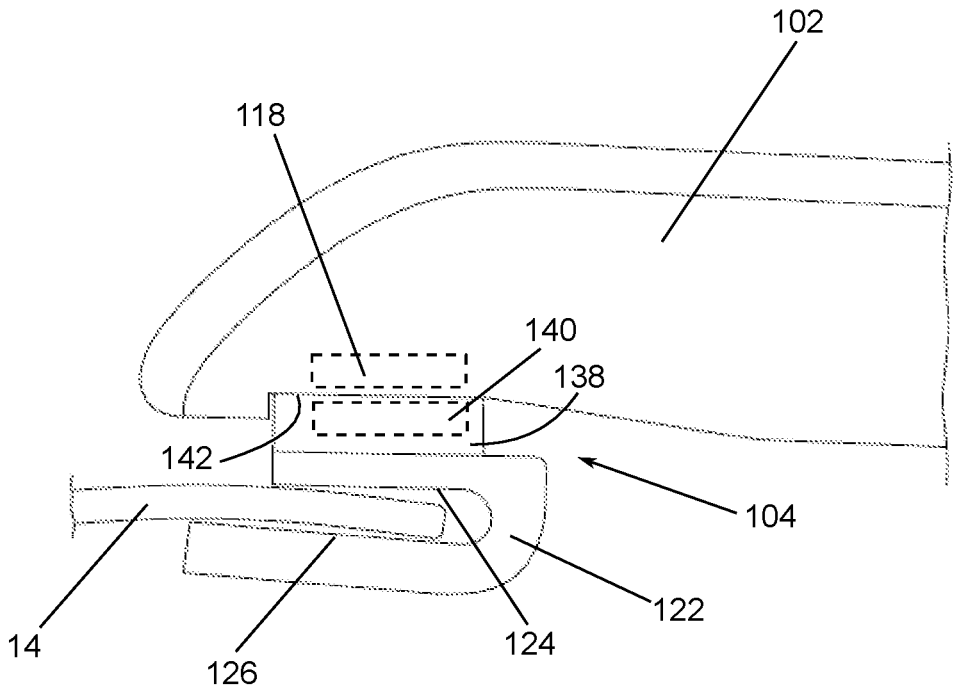
FIG. 5 is a side view showing the assembly of FIG. 4.
Figure 6:
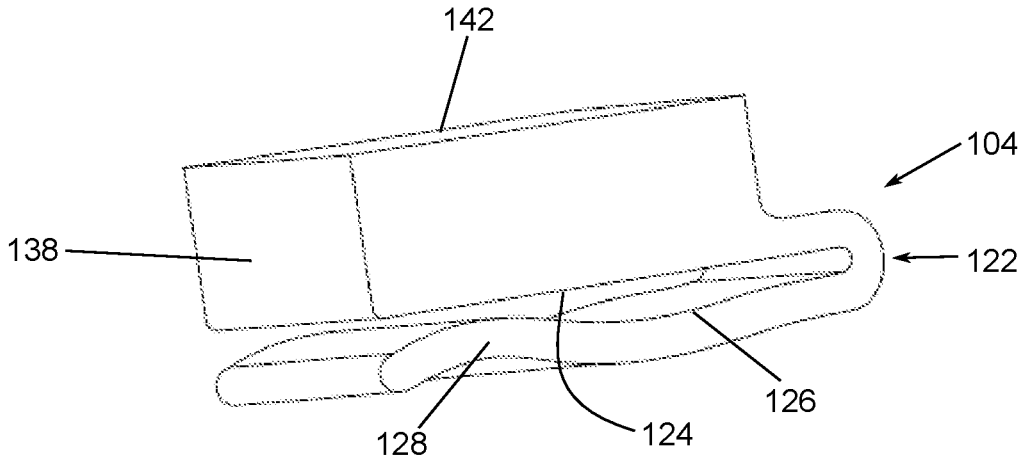
FIG. 6 is a perspective view of another embodiment of the attachment portion.

The attachment portions 104 are adapted to attach to a tongue 14 of a shoe 16. The attachment portions 104 may be attached to the tongue 14 by conventional attachment means, such as by sewing, adhesives, hook and loop fasteners (i.e. VELCRO™), or other mechanical fasteners. FIGS. 4 and 5 show one embodiment of the attachment portion 104. In this embodiment, the attachment portion 104 comprises a clip 122 configured to clip onto the tongue 14. Preferably, the clip 122 comprises first and second clip surfaces 124, 126 configured to slide over the top and bottom of the tongue 14, respectively. In another embodiment, shown in FIG. 6, the second clip surface 126 may comprise one or more undulations 128 to allow for better gripping of the clip 122 on the tongue 14. Preferably, the clip 122 is removably attachable to the tongue 14.

Figure 7:
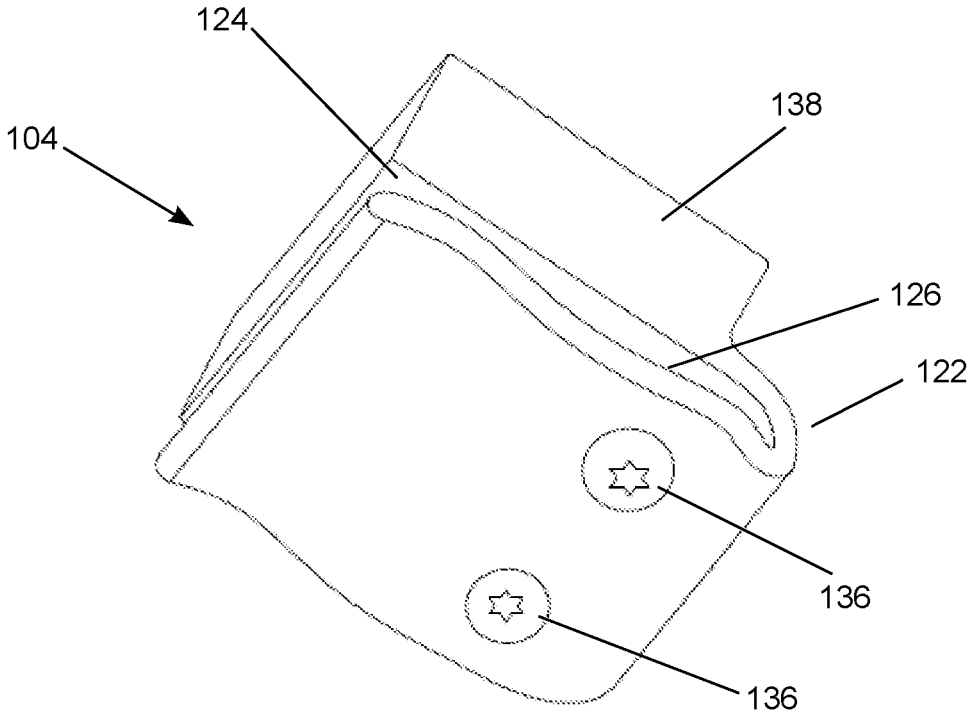
FIG. 7 is a perspective view of another embodiment of the attachment portion.

In another embodiment of the attachment portion 104, shown in FIG. 7, the clip 122 comprises one or more clip fasteners 136 that are intended to extend through the tongue 14. The clip fasteners 136 extend through the second clip surface 126 and may also extend to the first clip surface 124. The clip fasteners 136 may be screws, rivets, or the like. The clip fasteners 136 provide a more secure attachment of the attachment portion 104 to the tongue 14.

Figure 8:
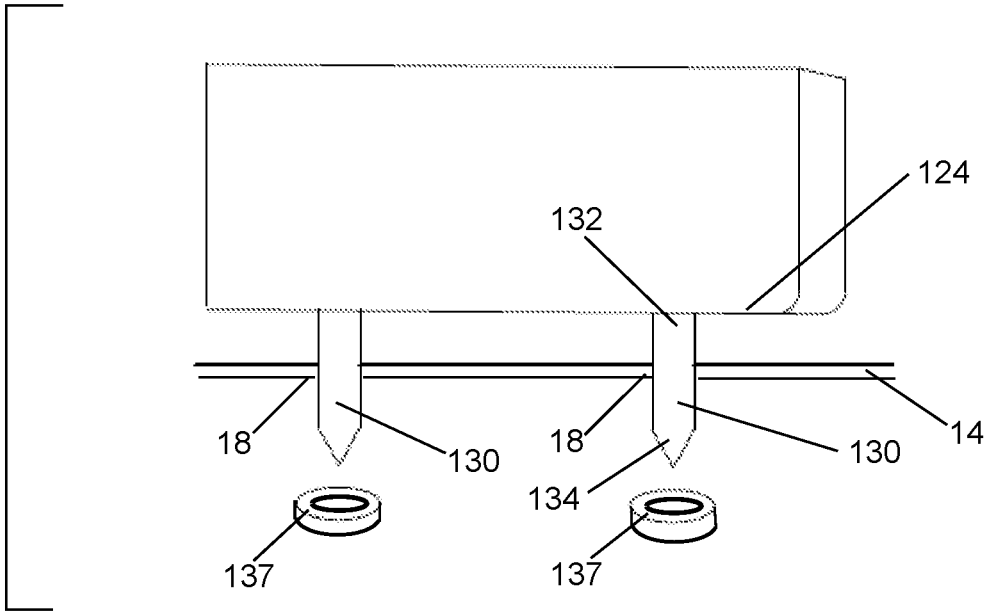
FIG. 8 is a side view showing another embodiment of the attachment portion.

In another embodiment of the attachment portion 104, shown in FIG. 8, the clip 122 comprises only the first clip surface 124. The first clip surface 124 is configured to slide over the top of the tongue 14. The clip 122 also comprises one or more protrusions 130 that extend away from the first clip surface 124. The protrusions 130 comprise first and second protrusion ends 132, 134 and extend through corresponding tongue openings 18 on the tongue 14. As shown in FIG. 8, the first protrusion end 132 is attached to the first clip surface 124. After the protrusion 130 has been passed through the tongue opening 18, a stopper 137 may be attached to the second protrusion end 134. Preferably, the stopper 137 will have a larger diameter than the tongue opening 18, such that the stopper 137 will prevent the clip 122 from being detached from the tongue 14.

Each of the attachment portions 104 further comprises a body portion 138. The body portion 138 may be connected to the clip 122. The body portion 138 comprises one or more attachment magnets 140. Preferably, the attachment magnet 140 generally corresponds in shape to the shoehorn magnet 118. For example, if the shoehorn magnet 118 has a generally cylindrical shape, the attachment magnet 140 preferably also has a generally cylindrical shape with similar dimensions.

The attachment magnet 140 may be located on or proximate to an outer surface 142 of the body portion 138. For example, in one embodiment, the attachment magnet 140 may be located below the outer surface 142 such that it is not visible. This may be accomplished, for example, by molding the body portion 138 using plastic and encasing the attachment magnet 140 within the body portion 138. Alternatively, the attachment magnet 140 may be situated such that it is substantially flush with the outer surface 142.

Preferably, when the attachment portion 104 is attached to the tongue 14, the attachment magnet 140 is oriented towards the top of the shoe 16, as shown in FIG. 4. For example, in the embodiment shown in FIGS. 1 to 5, the attachment portion 104 is attached to the top of the tongue 14, with the outer surface 142 oriented away from the top of the shoe 16. As a result, the attachment magnet 140 also is oriented away from the top of the shoe 16.

The general operation of the assembly 100 will now be described. The attachment portion 104 is attached to the tongue 14 of the shoe 16. When the user 10 wishes to put on the shoe 16, the user 10 grasps the shoehorn portion 102 by the handle 110. The user 10 then maneuvers the shoehorn portion 102 over the shoe 16 until one of the shoehorn magnets 118 in the shoehorn portion 102 is situated approximately above one of the attachment magnets 140 in the attachment portion 104. As a result of magnetic attraction, the attachment magnet 140 and the shoehorn magnet 118 will be attracted towards each other, and the two will tend to adhere to each other. Consequently, the first surface 116 of the shoehorn portion 102 will tend to adhere to the outer surface 142 of the attachment portion 104.

Once the first surface 116 has adhered to the outer surface 142, the user 10 can use the shoehorn portion 102 to move the attachment portion 104 (and thereby the attached tongue 14) away from the rest of the shoe 16 by pulling the shoehorn portion 102 in a direction away from the shoe 16. This would allow the user 10 to insert his or her foot 20 partway into the shoe 16 without the interference of the tongue 14. Once the foot 20 has been partly inserted into the shoe 16, the user 10 can disengage the shoehorn portion 102 from the attachment portion 104 by continuing to pull on the shoehorn portion 102 away from the shoe 16. Because the attachment portion 104 is securely attached to the tongue 14 (and by extension the shoe 16), the force exerted by the user 10 will eventually be sufficient to overcome the magnetic attraction between the shoehorn magnet 118 and the attachment magnet 140, causing the shoehorn portion 102 to detach from the attachment portion 104.

In one embodiment, by aligning the respective north/south polarities of the shoehorn magnet 118 and the attachment magnet 140, it is possible to ensure that the adherence of the shoehorn magnet 118 to the attachment magnet 140 occurs at the same approximate position and orientation each time. The respective moldings around the shoehorn magnet 118 and the attachment magnet 140 can be formed so that they engage with each other when the shoehorn magnet 118 and the attachment magnet 140 adhere. This allows the shoehorn portion 102 to be pulled without easily disengaging from the attachment portion 104. Alternatively, the shoehorn magnet 118 and the attachment magnet 140 may be shaped such that they engage with each other when adhered together. In this case, the user 10 may be required to twist the shoehorn portion 102 in order to disengage it from the attachment portion 104.

The user 10 can then use the shoehorn portion 102 in its conventional manner to assist in inserting the heel 12 into the shoe 16.

Figure 9:
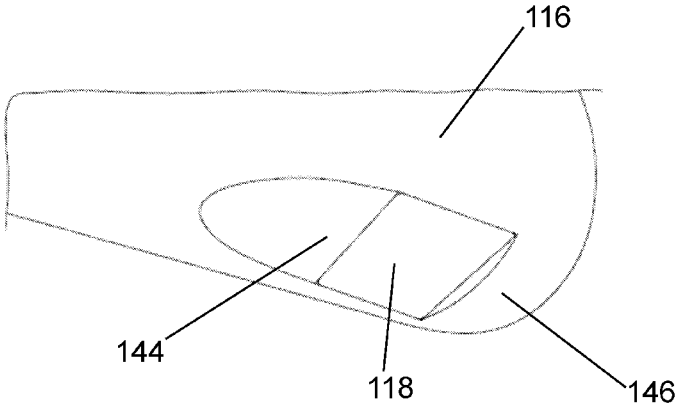
FIG. 9 is a partial perspective view of another embodiment of the shoehorn portion.
Figure 10:
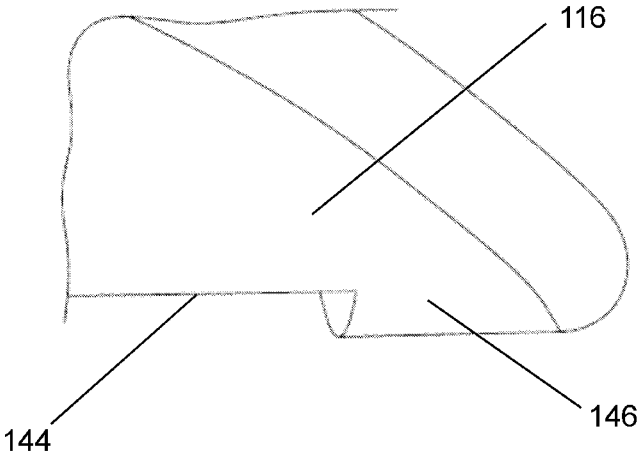
FIG. 10 is a partial side view of the shoehorn portion of FIG. 9.
Figure 11:
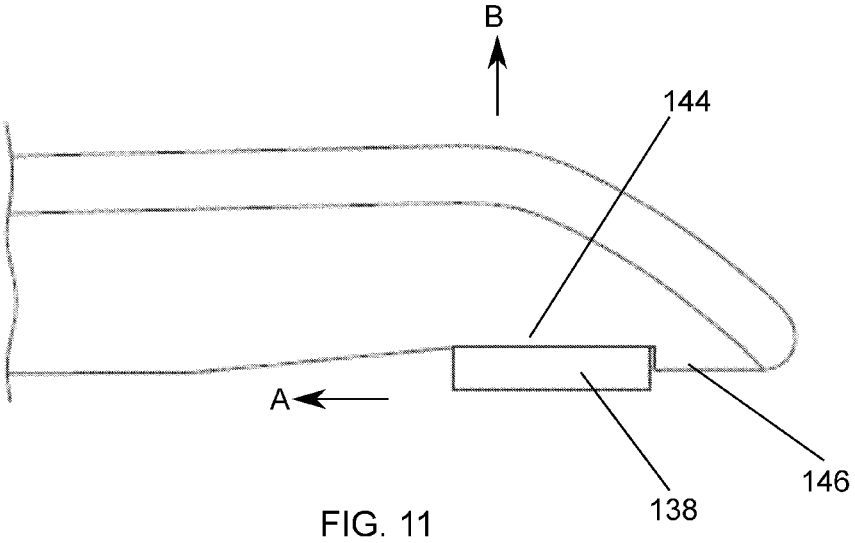
FIG. 11 is a partial side view showing the shoehorn portion of FIG. 9 attached to the attachment portion.

Referring to FIGS. 9 to 11, in another embodiment, the first surface 116 of the engagement member 114 comprises an engagement surface 144 and a ridge 146. The shoehorn magnet 118 is located on or proximate to the engagement surface 144. For example, the shoehorn magnet 118 may be located just below the surface of the engagement surface 144, close to where the engagement surface 144 meets with the ridge 146 (as shown in FIG. 9). Preferably, the ridge 146 is offset from the engagement surface 144 by a relatively small amount (in the range of from 0 to 4 millimeters).

When the shoehorn portion 102 is attached to the attachment portion 104, the attachment magnet 140 preferably engages the shoehorn magnet 118 on the engagement surface 144. Because of the presence of the ridge 146, lateral movement of the shoehorn portion 102 in direction A (shown in FIG. 11) is prevented because the ridge 146 would abut against the body portion 138 of the attachment portion 104. Therefore, in order to detach the shoehorn magnet 118 from the attachment magnet 140, the shoehorn magnet 118 must be pulled away from the attachment magnet 140 (in direction B). This will generally require greater force than if the shoehorn magnet 118 was to be detached from the attachment magnet 140 through simply sliding the shoehorn magnet 118 away from the attachment magnet 140. As a result, it is less likely that the shoehorn magnet 118 will be accidentally or unintentionally detached from the attachment magnet 140. In addition, this will allow for smaller (and less powerful magnets to be used for the shoehorn magnet 118 and/or attachment magnet 140.

Figure 12:
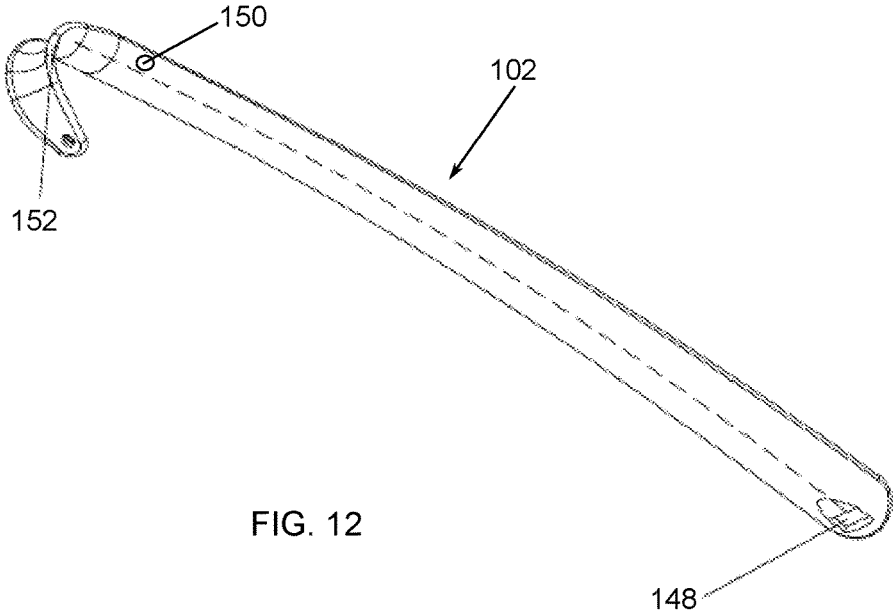
FIG. 12 is a perspective view of another embodiment of the shoehorn portion.

In another embodiment, shown in FIG. 12, the shoehorn magnet 118 may be an electromagnet 148. In this embodiment, the shoehorn portion 102 further comprises a power source 150 and a switch 152. The switch 152 is preferably located on the handle 110 such that the user 10 can easily access it. The power source 150 may be a battery or any other suitable power source. The switch 152 may be a push-button, a toggle switch, or any other suitable type of electrical switch. The power source 150, the switch 152, and the electromagnet 148 are electrically connected together. By closing the switch 152, the electromagnet 148 receives power and is activated. The shoehorn portion 102 can then be used as described above. By opening the switch 152, the electromagnet 148 will no longer receive power and will be deactivated.

Figure 12A:
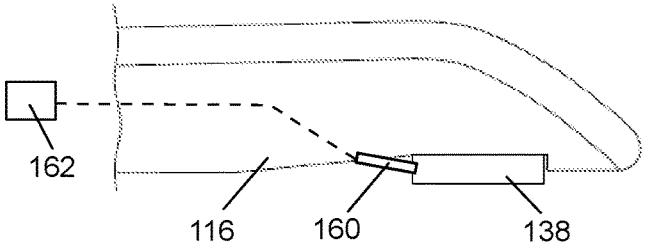
FIG. 12A is a partial side view of another embodiment of the shoehorn portion.

In another embodiment, referring to FIG. 12A, the attachment and detachment of the shoehorn magnet 118 to the attachment magnet 140 may be facilitated via a mechanical locking and/or release mechanism. For example, with respect to a locking mechanism, the first surface 116 may comprise one or more prongs 160 that engage with the body portion 138. The prongs 160 may be mechanically actuated (e.g. by springs or other suitable means) to selectively engage or disengage with the body portion 138. This selective engagement and disengagement may be controlled by the user 10 through a control mechanism 162, which may include a trigger, a push-button, a slider, or some other suitable control means.

Similarly, with respect to a release mechanism, the prongs 160 may be configured to push the body portion 138 away from the shoehorn magnet 118, thereby facilitating the release of the shoehorn magnet 118 from the attachment magnet 140. The prongs 160 may also be mechanically actuated (e.g. by springs or other suitable means). This release mechanism may also be controlled by the user 10 through the control mechanism 162.

Figure 13:
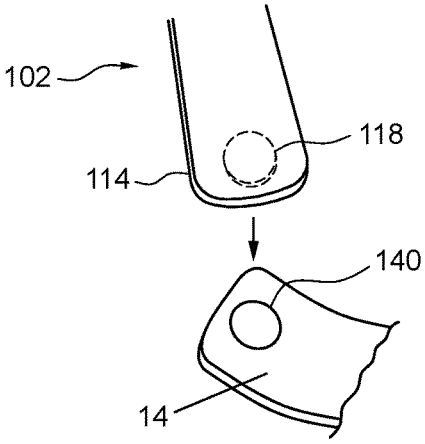
FIG. 13 shows another embodiment of the assembly.

In another embodiment, shown in FIG. 13, the attachment magnet 140 may be directly attached to the tongue 14, without the need for the clip 122. In this embodiment, the shoe 16 may be manufactured to incorporate one or more attachment magnets 140 inside of the tongue 14.

Figure 14:
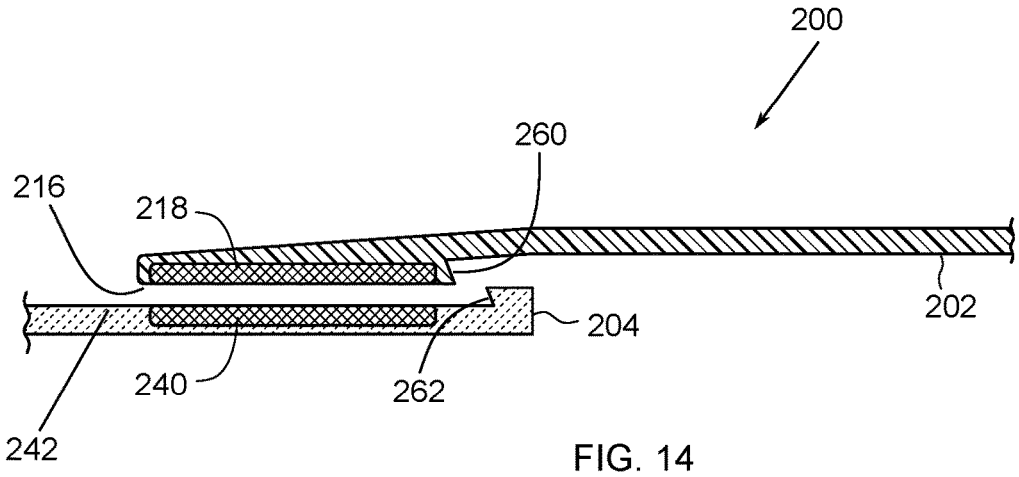
FIG. 14 shows a side view of another embodiment of the assembly.
Figure 15:
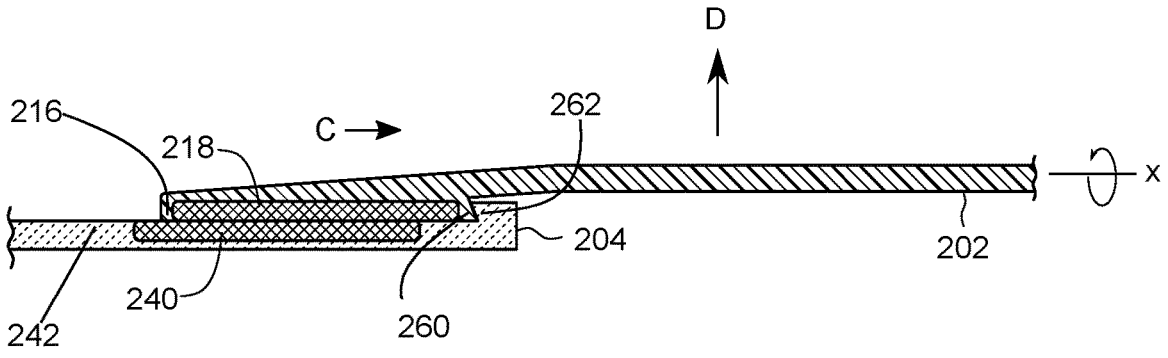
FIG. 15 shows a side view of the embodiment of FIG. 14, with the shoehorn portion and the attachment portion engaged together.
Figure 16:
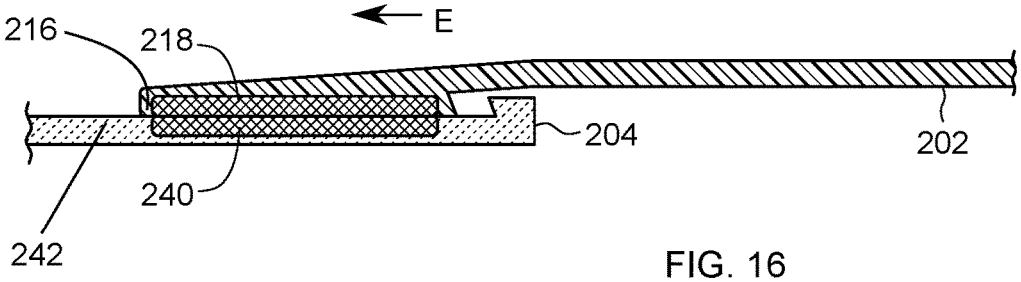
FIG. 16 shows a side view of the embodiment of FIG. 14, with the shoehorn portion and the attachment portion in the process of being disengaged.

FIGS. 14 to 16 show another embodiment of the invention. In this embodiment, the assembly 200 comprises shoehorn portion 202 and one or more attachment portions 204. As with the previous embodiments, the shoehorn portion 202 comprises one or more shoehorn magnets 218 on or proximate to first surface 216, and the attachment portion 204 comprises one or more attachment magnets 240 on or proximate to outer surface 242. However, the first surface 216 also comprises a first inclined surface 260 extending from the first surface 216. The first inclined surface 260 is designed to engage with a second inclined surface 262 present on the attachment portion 204. The respective first and second inclined surfaces 260, 262 help to create a more secure engagement of the shoehorn portion 202 with the attachment portion 204 than in the previous embodiments.

Operation of the assembly 200 is similar to that of the previous embodiments. The user 10 positions the shoehorn portion 202 approximately above the attachment portion 204, as shown in FIG. 14. The magnetic attraction between one of the shoehorn magnets 218 and one of the attachment magnets 240 causes the shoehorn portion 202 to tend to adhere to the attachment portion 204. Referring to FIG. 15, once adhered, when the user 10 pulls on the shoehorn portion 202 in a generally horizontal direction (i.e. direction C) towards the rear of the shoe 16, the first surface 216 of the shoehorn portion 202 will slide along the outer surface 242 of the attachment portion 204 until the first inclined surface 260 engages with the second inclined surface 262 (as shown in FIG. 15). Once engaged, the shoehorn portion 202 will not allow any further sliding movement of the first surface 216 along the outer surface 242 in direction C. In other words, the shoehorn portion 202 will resist any further pulling of it away from the shoe 16. In addition, because of the geometry of the first and second inclined surfaces 260, 262, vertical movement of the shoehorn portion 202 (i.e. in direction D) away from the attachment portion 204 is also resisted.

As with the previous embodiment, the user 10 can now insert the foot 20 partway into the shoe 16. Then, in order to detach the shoehorn portion 202 from the attachment portion 204, the user 10 can push the shoehorn portion 202 towards the front of the shoe 16 (as shown in FIG. 16). The first surface 260 will slide along outer surface 242 in the direction E shown in FIG. 16. When the shoehorn magnet 218 has slid past the attachment magnet 240, the magnetic attraction will have weakened sufficiently that the shoehorn portion 202 can be easily detached from the attachment portion 204.

Alternatively, the shoehorn portion 202 can also be detached from the attachment portion 204 by twisting the shoehorn portion 202 generally about its longitudinal axis x. By doing so, the twisting force should be sufficient to overcome the magnetic attraction between the shoehorn magnet 218 and the attachment magnet 240 and the physical engagement of the first and second inclined surfaces 260, 262.

Once the shoehorn portion 202 has been detached from the attachment portion 204, the shoehorn portion 202 can be used in its conventional manner to assist in inserting the heel 12 into the shoe 16.

In addition to be used to assist the user 10 in putting on footwear, the shoehorn portion 102 can also be used to pick up magnetic objections on the ground, without requiring the user 10 to bend over.

The assembly 100 may also be used in other applications. For example, the attachment portions 104 may be attached to curtains or blinds. The shoehorn portion 102 can then be attached to the attachment portion 104 (as described above) to move or manipulate the curtains or blinds.

It will be appreciated by those skilled in the art that the preferred embodiments have been described in some detail but that certain modifications may be practiced without departing from the principles of the invention.

The invention claimed is:

1. An assembly for assisting a user in putting on footwear having a tongue onto a foot of the user, the assembly comprising:

a shoehorn portion comprising an elongated handle and an engagement member, wherein the engagement member comprises:

a first surface defined between two longitudinal side edges, wherein at least a portion of the first surface is concave in a direction transverse to the two longitudinal side edges and configured to engage with a heel of the foot; and one or more shoehorn magnets situated proximate to the first surface; and one or more attachment portions, wherein each of the one or more attachment portions is configured to be removably attached to the tongue and wherein each of the one or more attachment portions comprises:

a clip configured to removably attach the one or more attachment portions to the tongue; and a body portion connected to the clip, wherein the body portion comprises one or more attachment magnets configured to engage with the one or more shoehorn magnets;

wherein the engagement of the one or more attachment magnets to the one or more shoehorn magnets allows the user to manipulate a movement of the tongue.

2. The assembly of claim 1, wherein the engagement member further comprises a cavity for accommodating the one or more shoehorn magnets.

3. The assembly of claim 2, wherein the one or more shoehorn magnets lie substantially flush with the first surface.

4. The assembly of claim 1, wherein the clip comprises first and second clip surfaces configured to slide over a top and a bottom, respectively, of the tongue.

5. The assembly of claim 1, wherein the clip comprises:

a first clip surface configured to slide over a top of the tongue;

one or more protrusions extending away from the first clip surface, wherein the one or more protrusions are configured to extend through the tongue through openings formed on the tongue; and fasteners attached to the one or more protrusions, wherein the fasteners prevent removal of the clip from the tongue.

6. The assembly of claim 1, wherein the body portion comprises an outer surface, wherein the one or more attachment magnets are located on or proximate to the outer surface.

7. The assembly of claim 1, wherein the first surface comprises an engagement surface and a ridge, wherein the one or more shoehorn magnets are located on or proximate to the engagement surface.

8. The assembly of claim 7, wherein the ridge is offset from the engagement surface by between 0 and 4 millimeters.

9. The assembly of claim 7, wherein the ridge is configured to prevent lateral movement of the shoehorn portion with respect to the one or more attachment portion in one direction.

10. The assembly of claim 1, wherein the one or more shoehorn magnets are electromagnets.

11. The assembly of claim 10, wherein the shoehorn portion further comprises a power source and a switch, wherein the power source and the switch are electrically connected to the one or more shoehorn magnets.

* * * * *